United States Patent [19]

Wargo

[11] 4,352,261

[45] Oct. 5, 1982

[54] SKIRT CONSTRUCTION FOR MOBILE HOME

[76] Inventor: Louis Wargo, 5255 State Rd., No. 89, Ashtabula, Ohio 44004

[21] Appl. No.: 173,857

[22] Filed: Jul. 30, 1980

[51] Int. Cl.[3] ..... E02D 27/00

[52] U.S. Cl. ..... 52/169.12; 52/DIG. 3

[58] Field of Search ..... 52/DIG. 3, 169.12, 169.9, 52/299

[56] References Cited

U.S. PATENT DOCUMENTS

| | | | |
|---|---|---|---|
| 2,961,255 | 11/1960 | Trott | 52/169.12 |
| 3,256,655 | 6/1966 | Teeter | 52/DIG. 3 |
| 3,451,180 | 6/1969 | Struben | 52/DIG. 3 |
| 3,537,218 | 11/1970 | Hindman | 52/DIG. 3 |
| 3,710,525 | 1/1973 | Lopes | 52/DIG. 3 |
| 3,785,675 | 1/1974 | Norris | 52/DIG. 3 |
| 3,877,188 | 4/1975 | Struben | 52/DIG. 3 |
| 4,107,888 | 8/1978 | Krueger | 52/DIG. 3 |
| 4,112,638 | 9/1978 | Hanson | 52/DIG. 3 |

*Primary Examiner*—John E. Murtagh
*Assistant Examiner*—Henry E. Raduazo

[57] ABSTRACT

Skirt construction for mobile homes which includes a series of individual panels, interconnected at their vertical edges, and rod members connected at their upper ends, extending downwardly through the connections of the panels and into the ground to prevent lateral displacement of the panels, yet permitting relative individual movement of each when the ground heaves or settles.

2 Claims, 4 Drawing Figures

SKIRT CONSTRUCTION FOR MOBILE HOME

BACKGROUND OF THE INVENTION

The invention herein relates to skirting for what are known as mobile homes, and particularly such skirt construction as will cover the space between the body of a mobile home and the ground above which the same is supported so as to prevent air movement as well as to provide a neat appearing condition, there having been however contemplated a number of constructions to accommodate for the conditions which exist and which are found in various mobile home parks, which in turn are undesirable where skirting is used which is of fixed connection to the body and extends to the ground.

There have been a number of proposed forms of accommodating for changes in the ground condition due to frost or other circumstances, such as those shown in the U.S. Pat. No. 3,834,109, wherein horizontal skirt elements will permit certain limited movement of the ground with respect to the body and still maintain some coverage substantially of that space.

Another patent, U.S. Pat. No. 3,710,525, similarly provides for changes in ground attitude, but the horizontal condition of the elements, does not make possible the best coverage of such opening nor prevent exposure of a part and thus leakage of air.

It is of course desirable to prevent lateral displacement of the skirt elements in any event, and irrespective of how the space is closed, it is also very desirable to prevent the passage of air beneath any of the panels and thus beneath the mobile home, so as to make the same warmer in the wintertime when the frost conditions exist.

Other patents may exist which in any case generally contemplate the overall conditions existing but do not overcome the same, or provide satisfactory results under widely varying conditions.

GENERAL DESCRIPTION OF THE INVENTION

The invention contemplated hereby, involves the provision of a series of separate skirt members which are in the form of panels, which panels are usually formed of plastic or the like and configured so as to provide some rigidity, being intended, to extend from beneath the body of the mobile home to the ground, and yet provide for a certain amount of uneveness or changes in the ground attitude from time to time. This will result in individual panels moving vertically, where they are supported, but if fastened rigidly at their upper ends and extending to the ground will cause some buckling as will be apparent.

It is contemplated hereby to accomodate for variations and changes in the ground attitude by having the individual panels move individually, within limits vertically, being guided by certain positioning means which extend through the connections of the individual panels being fastened at their upper ends to the body of the mobile home and extending at their lower ends into the ground to in effect provide guiding means as the panels are permitted to move upwardly and downwardly individually.

While it is contemplated that the upper ends of the panels may have certain facia to cover the same, this forms no part of the invention except insofar as it provides a neat appearance and permits the changes to take place without objectionable appearance.

With the foregoing in mind, it is contemplated that the invention hereof will be incorporated into certain relatively simple elements, which in turn provide for the necessary flexibility, and as will be apparent from a consideration of the specification which follows, will have additional advantages not heretofore set forth in detail, but which are shown in the drawings and in the individual figures wherein.

DETAILED DESCRIPTION OF THE INVENTION

Figure 1:
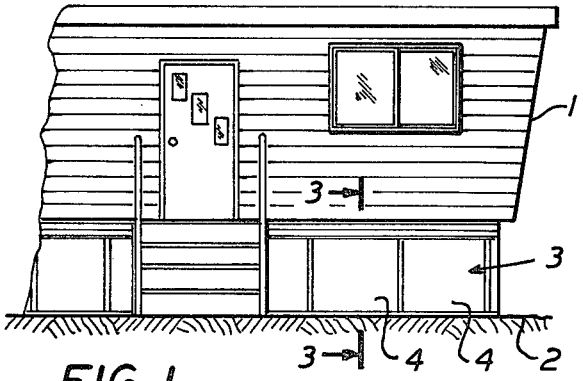
FIG. 1 is a fragmentary view of a portion of a mobile home, indicating the area below the same in which the skirt construction hereof is positioned.
Figure 2:
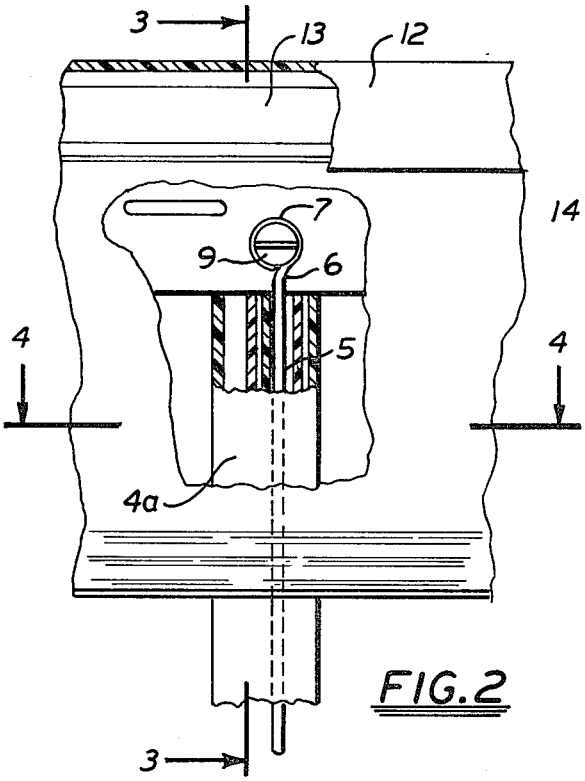
FIG. 2 is a fragmentary, partly sectional view showing certain detailed construction of the concept hereof and other elements desired for use in connection therewith.

Referring to FIG. 1, a mobile home indicated at 1, is provided with any kind of suitable supporting means not shown so as to be spaced from the ground suggested at 2.

In the space between the body of the mobile home 1 and the ground 2, a skirt construction generally denoted 3 is usually provided.

Figure 4:
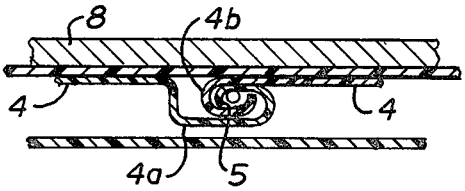
FIG. 4 is a fragmentary cross-sectional view taken about on the line 4—4 of FIG. 2 looking in the direction of the arrows.

Specifically the skirt construction of this invention, is arranged so as to have the individual panels designated 4, of suitable construction so that they are interconnected as shown in FIG. 4 for example by the formation of the panels which are plastic, and each having a connection such as **4*a* at one edge and 4*b*** at the other edge, which interconnections may be arranged so that they will either snap into engagement or slide into engagement one with the other.

It will be observed that this provides a central opening between the respective panels generally denoted 5 and extending vertically as will be apparent.

This vertical opening is also shown in the other views, as being a passageway or other form of opening which will conceal and at the same time provide some rigidity to the panels themselves, the positioning means hereof being denoted 6 in the form of a rod member, having an eye formed at its upper end and denoted 7.

The rods 6 will usually be positioned at each of the connections between the panels, and connected as they are, the rod at the eye 7 thereof, will be fastened to the body which includes an individual chassis member 8, by means of a metal screw such as 9 for example.

Figure 3:
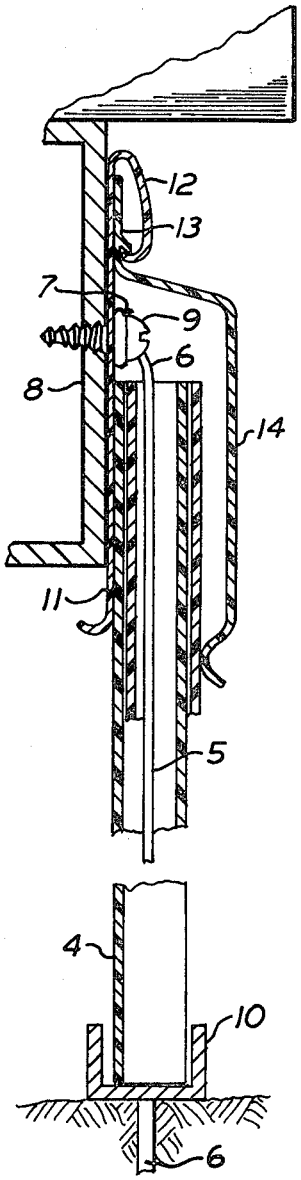
FIG. 3 is a fragmentary sectional view taken about on the line 3—3 of FIG. 1 looking in the direction of the arrows.

The rod or rods 6 will thereafter be positioned so as to extend downwardly through the connections as before noted and into the ground as suggested in FIG. 3, extending thereinto a substantial distance preferably 12 to 18 inches, depending upon the ground and the wind conditions which will be encountered by the construction.

Usually in construction of this kind, a suitable channel such as 10 is provided on the ground and to receive the lower ends of the individual panels 4, so as to assist in positioning the same and in this arrangement, the rods 6 will extend downwardly through the channel as well, and into the ground therebelow.

From the foregoing it will be clear that the individual panels may move with regard to one another and be maintained in their movement along the rods 6 upwardly and downwardly, being shown in FIG. 3 at probably the uppermost extent of movement, with the lower extent of movement under frost conditions change being somewhat different as might be expected.

The entire construction of this panel arrangement may include a suitable back member 11 in rear of the entire structure having at its upper end a horizontally extending loop 12, adapted to receive within it, the upper end 13 of a facia member 14 which is a longitudinal element as will be apparent, arranged to cover the upper edges of the panel and thereby conceal the connections of the rod members 6 with the body of the mobile home 1.

While it is believed clear from the foregoing that the manner of assembly and actual operation of the respective parts of this invention will be understood from the detailed description, it may be desirable to summarize by stating that initially the various supporting rods 6 will be positioned at suitable intervals to correspond with the width of the panels of the skirt construction, so that they will not only enter through the channel 10 and into the ground but be fixed at their upper ends by the eye 7 provided to the chassis or frame of the mobile home 1.

Thereafter by suitable manipulation of the panels, formed with the interconnecting arrangements disclosed in FIG. 4, will be such as to permit the panel or one panel to be snapped into place, with its edge encircling the rod 6, and thereafter the next panel connected by reason of the fact that the panels are resilient and may be slid into place likewise.

It may under some circumstances be more convenient and perhaps desirable to place the rods in their position, slip the connected panels 4 into place and thereafter fasten the eyes 7, since spacing would therefore be easily determined and not have to be laid out in advance.

It will also be clear from the foregoing that the provision of these rods will be such that the panels comprising the skirt will not only be rigidly positioned against lateral displacement by the wind or the like, but at the same time would be permitted to rise and fall, as ground conditions affect the same in such a manner as to cause that kind of an action.

I claim:

1. Skirt construction for a mobile home having a body supported in spaced relation above the ground, said construction comprising skirt means positioned in the space between the body and the ground, and positioning means engaging said means and extending from the body downwardly and into the ground to prevent lateral displacement of the skirt means, whilst permitting at least limited vertical movement of portions of said skirt means, said skirt means comprising a series of individual panels having interlocking connection with each other to form a continuous skirt, and the positioning means extend within the connection of at least certain of said panels from the body downward and into the ground.

2. Skirt construction as claimed in claim 1, wherein the positioning means are rod members, each having an eye formation at its upper end to provide for connection to the body, a channel extends along the ground, the lower extremities of the panels being received therein to maintain longitudinal alignment thereof, and the rod members extend through the connection of at least certain of the panels from the eye formation by which each rod is connected to the body, downwardly, and at their lower ends, extend through the channel and into the ground.

* * * * *